US008333603B1

(12) United States Patent
Daugherty et al.

(10) Patent No.: US 8,333,603 B1
(45) Date of Patent: Dec. 18, 2012

(54) ELECTRICAL CONNECTION SYSTEM HAVING DIELECTRIC SPRING TO ABSORB AXIAL POSITIONAL MATING TOLERANCE VARIATION FOR MULTIPLE CONNECTORS

(75) Inventors: James D. Daugherty, Brookfield, OH (US); Mark D. McCall, Hubbard, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 13/113,313

(22) Filed: May 23, 2011

(51) Int. Cl.
*H01R 13/64* (2006.01)

(52) U.S. Cl. ..... 439/248

(58) Field of Classification Search ..... 439/248, 439/249, 540.1
See application file for complete search history.

(56) References Cited

U.S. PATENT DOCUMENTS 4,268,729 A * 5/1981 Gaizauskas ..... 200/50.3
4,295,703 A * 10/1981 Osborne ..... 439/403
4,671,582 A * 6/1987 Stromquist et al. ..... 439/31
4,718,857 A * 1/1988 Noschese ..... 439/292
4,778,411 A * 10/1988 Rudy et al. ..... 439/681
4,789,351 A 12/1988 Fisher, Jr.
4,864,721 A * 9/1989 Rudy et al. ..... 29/825
4,995,821 A * 2/1991 Casey ..... 439/157
5,090,920 A * 2/1992 Casey ..... 439/540.1
5,486,115 A * 1/1996 Northey et al. ..... 439/108
5,860,819 A * 1/1999 Northey et al. ..... 439/108
6,273,762 B1 * 8/2001 Regnier ..... 439/701
6,343,958 B1 2/2002 Wayman
6,361,374 B1 * 3/2002 Lloyd et al. ..... 439/701
6,412,986 B1 * 7/2002 Ngo et al. ..... 385/53
7,601,019 B2 10/2009 Hsieh

* cited by examiner

*Primary Examiner* — Amy Cohen Johnson
*Assistant Examiner* — Vladimir Imas
(74) *Attorney, Agent, or Firm* — Thomas N. Twomey

(57) ABSTRACT

A ganged electrical connection system includes an arrangement having a spring including a plurality of engagement portions. A plurality of first connectors is receivably coupled in a plurality of receptacles in the arrangement and a plurality of second connectors is matable to the coupled first connectors along mating axes. The plurality of coupled first connectors have floatable movement in the plurality of receptacles. The floatable movement is in at least an axial direction in relation to the plurality of receptacles and the axial positional mating tolerance variation of each second connector in the plurality of second connectors in relation to each first connector in the plurality of coupled first connectors that manifests at each receptacle in the plurality of receptacles is assimilated by each respective spring engagement portion when the plurality of second connectors mate to the plurality of coupled first connectors.

9 Claims, 9 Drawing Sheets

ELECTRICAL CONNECTION SYSTEM HAVING DIELECTRIC SPRING TO ABSORB AXIAL POSITIONAL MATING TOLERANCE VARIATION FOR MULTIPLE CONNECTORS

RELATED DOCUMENTS

This application is related to U.S. non-provisional application U.S. Ser. No. 13/113,286 entitled "ELECTRICAL CONNECTION SYSTEM THAT ABSORBS MULTI-CONNECTOR POSITIONAL MATING TOLERANCE," and non-provisional application U.S. Ser. No. 13/113,301 entitled "BI-DIRECTIONAL CPA MEMBER TO PREVENT UNMATING OF MULTIPLE CONNECTORS," that are each co-owned by the assignee of this application and are incorporated by reference herein. The instant U.S. non-provisional application and the abovementioned non-provisional applications have been harmoniously filed on the same day of 23 May 2011.

TECHNICAL FIELD

This invention relates to an electrical connection system that absorbs axial positional mating tolerance variation during mating of connectors in the electrical connection system.

BACKGROUND OF INVENTION

It is known that the electrical performance of electrical components in electrical communication with an electrical connection array is, in part, dependent on the quality of the electrical connections contained within the electrical connection array.

In some applications where an electrical connection array is employed, larger than normal tolerances in the positioning of the connection terminations may occur, for example, due to limitations in a manufacturing process used to produce the electrical connection array. These connection position tolerances may have an X- and a Y- and a Z-axis mating variation component. Normally, connection array tolerances are controlled tight enough to assure that the mating terminals in the device connection system array interface properly in alignment, such as may occur when there is minimal external strain on a terminal contact interface within the electrical connection array. If undesired larger than normal tolerances are encountered during the mating of connectors in the electrical connection array, misalignment of the connectors may occur that may cause undesired poor quality or faulty electrical connections that may negatively affect the electrical performance of electrical components electrically connected with the electrical connection array. In other circumstances, connectors in the connection system array may not be matable as a result of excessive tolerance variation or may be irrevocably damaged during the mating process due to connector misalignment that may undesirably leave the electrical components inoperative. Additional servicing to repair a damaged electrical connection array may also undesirably increase service costs. A robust, consistent, smooth mating of connectors in the connection array having mating tolerance variation between the connectors remains desirable especially where the mating tolerance has at least an axial, or Z-axis component along the mating axis. In electrical applications where a large number of connections are required, it may be advantageous to be able to gang some number of connections together in a single arrangement where the connections mate in a single unimpeded mating connection to save time and allow for ease of assembly.

Thus, what is needed is a reliable, robust electrical connection system that allows for positional mating tolerance variation between multiple connectors having at least a Z-axis positional mating tolerance variation component in the electrical connection system that is absorbed within the electrical connection system so that repeatable, consistent, and high-quality electrical connections in the electrical connection system are attained when connectors in the electrical connection system are mated. The absorption of at least the Z-axis positional mating tolerance variation component within the electrical connection system is also being unaffected by the number of mating devices and/or the number of terminations within the mating devices in the mating device arrangement.

SUMMARY OF THE INVENTION

In accordance with an embodiment of the invention, a ganged electrical connection system includes an arrangement. The arrangement includes a spring having a plurality of engagement portions and defines a plurality of receptacles where the plurality of engagement portions communicate with the plurality of receptacles. A plurality of first connectors is receivably coupled in the plurality of receptacles and a plurality of second connectors are matable to the coupled first plurality of connectors along mating axes. The plurality of receptacles are configured for floatable movement of the plurality of coupled first connectors within the plurality of receptacles in at least an axial direction in relation to the plurality of receptacles. When the plurality of second connectors are mated to the plurality of coupled first connectors, axial positional mating tolerance variation of each second connector in the plurality of second connectors in relation to each coupled first connector in the plurality of coupled first connectors that manifests at each receptacle in the plurality of receptacles is assimilated by each respective engagement portion in of the spring.

These and other advantageous features as disclosed in the embodiments of the present invention will be become apparent from the following brief description of the drawings, detailed description, appended claims and drawings.

BRIEF DESCRIPTION OF THE DRAWINGS

This invention will be further described with reference to the accompanying drawings in which.

DETAILED DESCRIPTION

Figure 1:
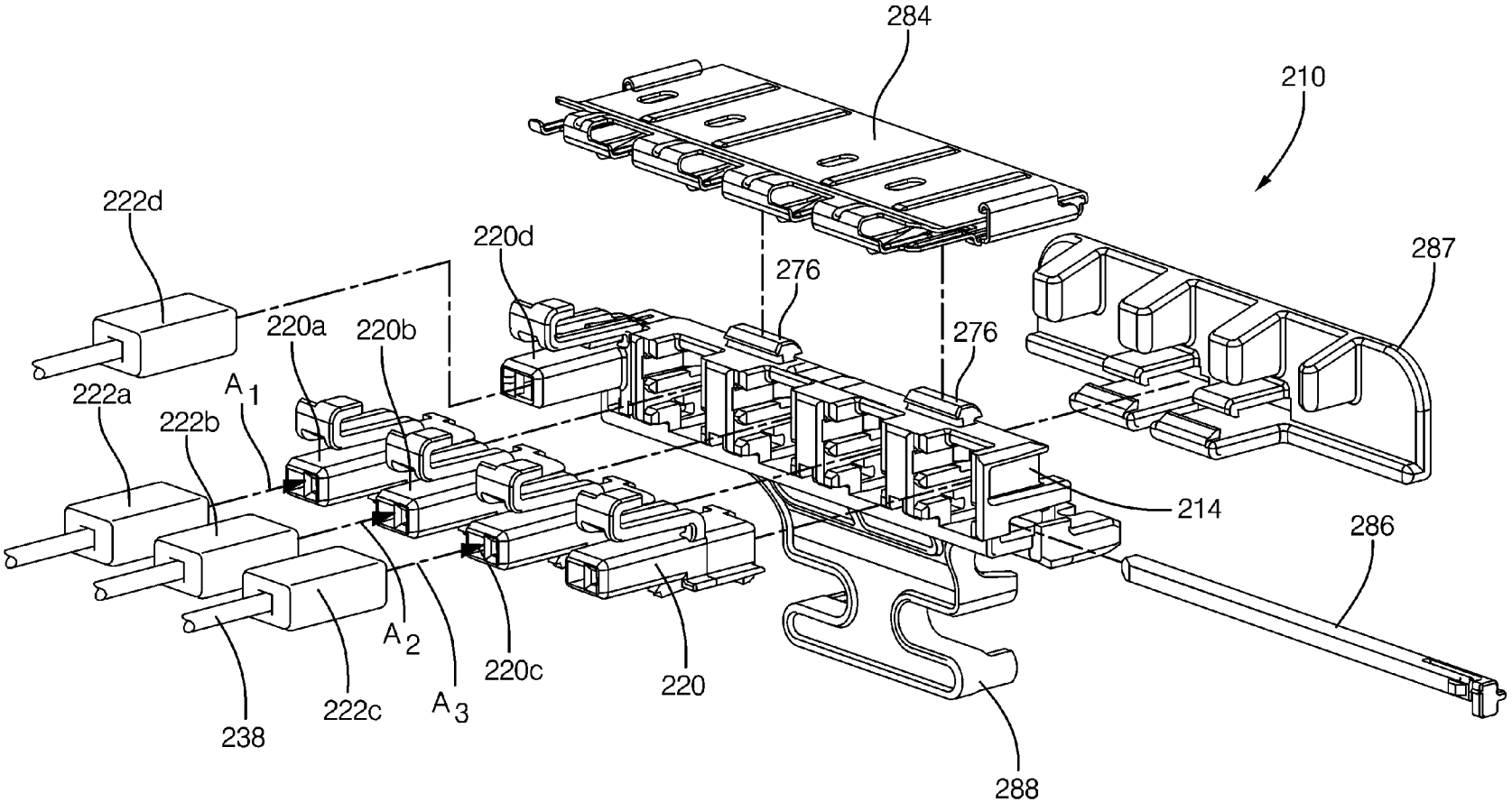
FIG. 1 shows an exploded view of an electrical connection system according an embodiment of the invention.

Electrical components in an electrical system may be electrically joined, or connected in electrical circuits by one or more electrical connection assemblies, or systems. Electrical connection systems may be found in abundance in many industries such as the automotive, marine, and airline industries. In the automotive industry, electrical connector assemblies are used in various types of electrical systems such as bussed electrical centers (BECs), engine compartments, RF communication systems, and the like. In certain electrical system applications, positional mating tolerance variation may be specified between individual sets of connectors in the electrical connection system. Positional mating tolerance variation relates to how closely a set of connector halves in the electrical connection system align as the connector halves are mated. For example, the electrical connection system has increased positional mating tolerance variation when the connectors have more mis-alignment, off-alignment, or mis-registration between the connectors when the connectors are mated. The mis-alignment may have an X- or a Y- or an axial, or Z-axis direction component and may also have mis-alignment in any combination of these directions. In some electrical applications, inherent positional mating tolerance variation may be understood in a suitable manner so as to be predetermined before the electrical connection system is constructed. Additionally, there may be inherent positional mating tolerance variation for each connector in the ganged electrical connection system. Once the predetermined positional mating tolerance is understood in a particular electrical application, the electrical connection system may be constructed in a manner to incorporate the assimilation of the predetermined positional mating tolerance variation within the electrical connection system. Consequently, the constructed electrical connection system may assimilate, or absorb the predetermined positional mating tolerance variation for each connector set in the electrical connection system when the connector sets are mated together, regardless of the number of connectors. The electrical connection system may absorb at least a portion of the specified positional mating tolerance variation in the X- or the Y- or the Z-direction or in any combination thereof up to the predetermined positional mating tolerance between each set of connectors during the mating of the more than one set of connectors to ensure an unimpeded, uninterrupted, and smooth, high-quality mating connection of the connectors. One such electrical connection system that absorbs at least a portion of the specified positional mating tolerance variation in the X- or the Y- or the Z-direction or in any combination thereof up to the predetermined positional mating tolerance between each set of connectors is presented in non-provisional application U.S. Ser. No. 13/113,286 entitled "ELECTRICAL CONNECTION SYSTEM THAT ABSORBS MULTI-CONNECTOR POSITIONAL MATING TOLERANCE VARIATION," and is incorporated by reference herein. Thus, a maximum total amount of possible positional mating tolerance variation that may be assimilated by the electrical connection system is a sum of the individual positional mating tolerance variations for each set of connectors disposed in the electrical connection system. The predetermined positional mating tolerance variation may also incorporate structural size of the individual connectors that may vary over time when the connectors are manufactured. "Float" is constructed in to the electrical connection system to absorb the predetermined positional mating tolerance variation. "Float" is a term used in the electrical connection arts that means to drift or move gently, and as used herein, applies to a connector in the electrical connection system that is allowed to move gently while not generally being fixedly secured in one place.

Figure 2:
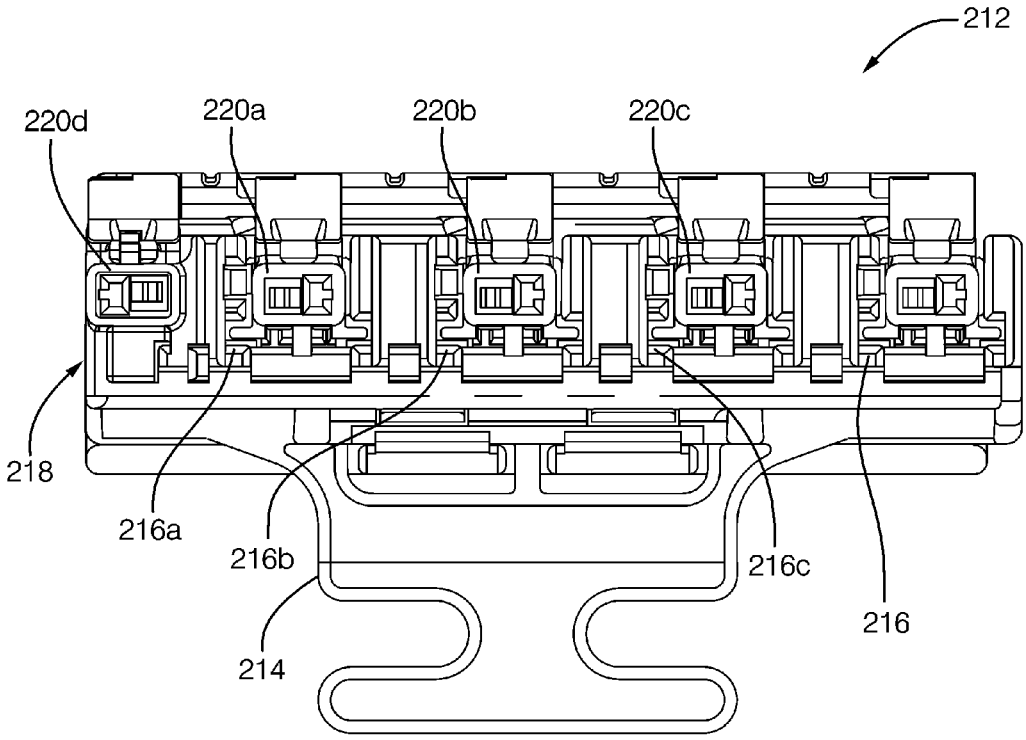
FIG. 2 shows a rear-side view of an arrangement of the electrical connection system of FIG. 1, and details thereof.

Referring to FIGS. 1-14, a ganged electrical connection system 210 is formed along a mating axis A that includes mating axes $A_1$, $A_2$, $A_3$ and absorbs positional mating tolerance in an X- and a Y- and an axial, or Z-axis direction. Referring to FIGS. 1 and 2, system 210 includes an arrangement 212, a plurality of female connectors, connector housings, or bodies 220, and a plurality of male connectors, connector housings, or bodies 222. Arrangement 212 includes a support frame 214 where female connectors 220*a-c* are receivably coupled in a plurality of receptacles 216*a-c* defined in support frame 214. Wire conductors 236 are respectively attached to coupled female connectors 220. Male connectors 222 mate to coupled female connectors 220 of support frame 214 along a mating axes $A_1$, $A_2$, $A_3$. Wire conductors 238 are respectively attached to terminals (not shown) that are respectively disposed in male connectors 222.

Figure 7:
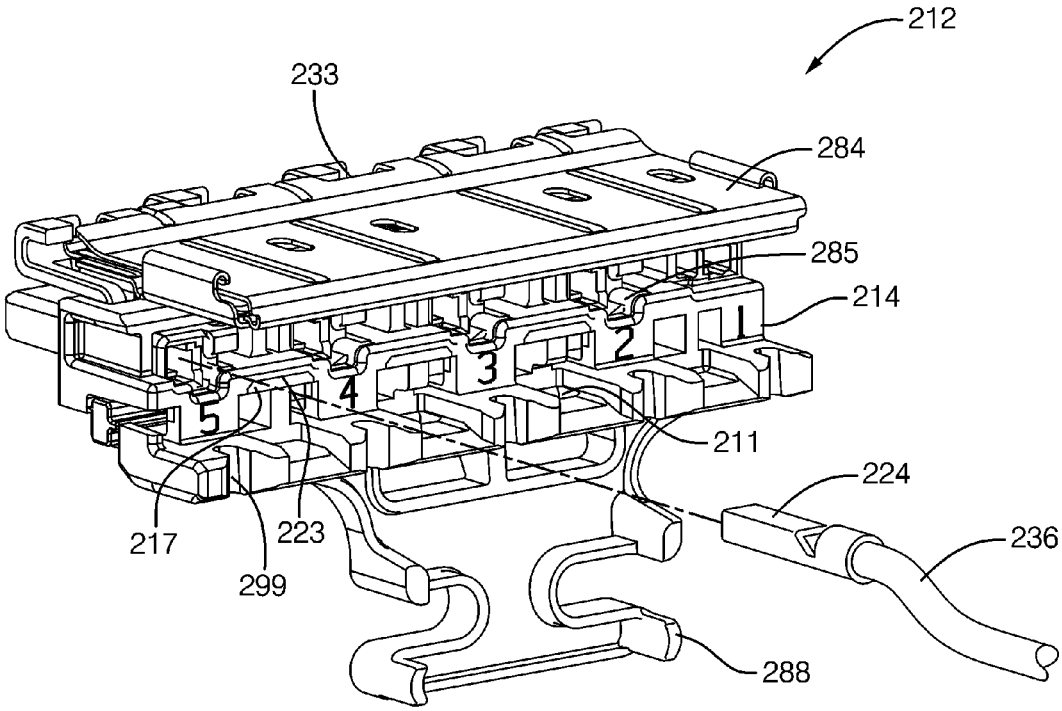
FIG. 7 shows a frontal view of the arrangement of FIG. 5, showing insertion of female terminals into the coupled first connectors.
Figure 11:
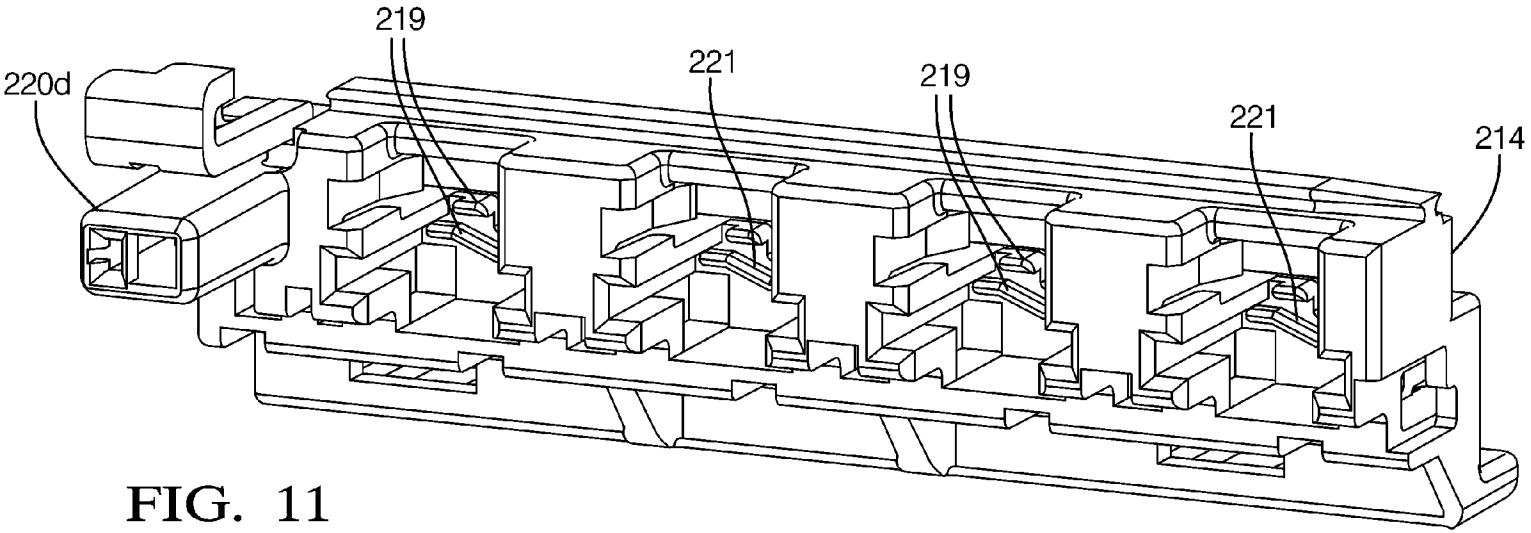
FIG. 11 shows a portion of the support frame of the electrical connection system of FIG. 5 with the first connectors removed, showing spring details thereof.
Figure 12:
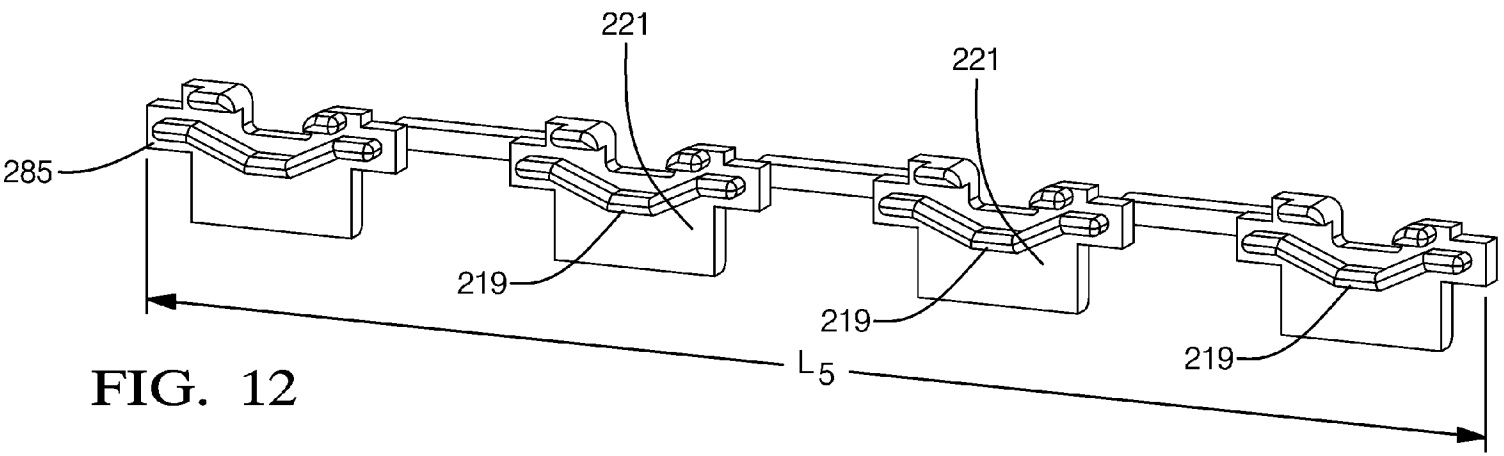
FIG. 12 shows the one-piece spring of the support frame of FIG. 11, and details thereof.
Figure 13:
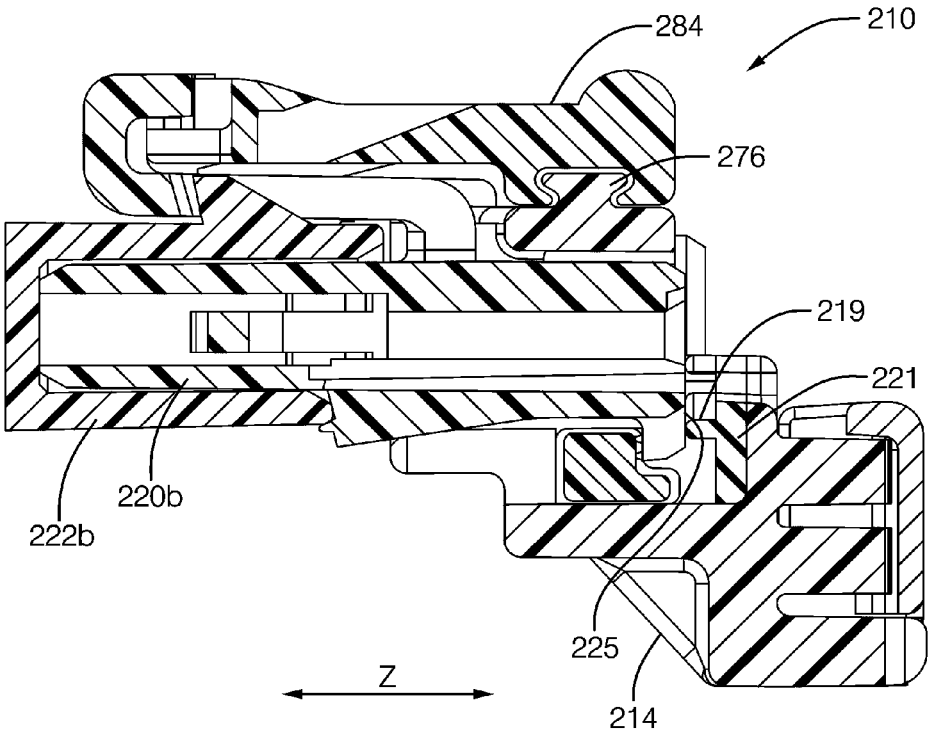
FIG. 13 shows a cross section view of the electrical connection system of FIG. 5, and spring details thereof.
Figure 14:
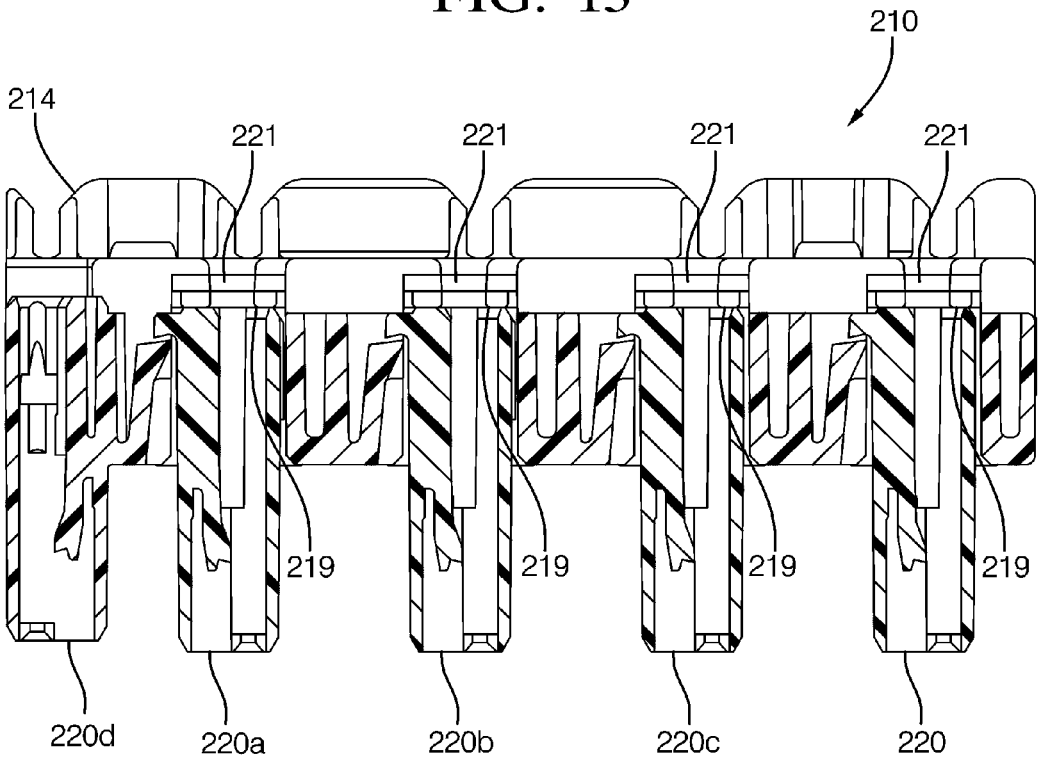
FIG. 14 shows a topical cross section view of the electrical connection system of FIG. 5, and spring details thereof.

Referring to FIGS. 7 and 11-14, arrangement 212 further includes a spring 285 formed of a dielectric material. Spring 285 includes a plurality of tongue portions 217, a plurality of engagement portions 219, and a plurality of non-engagement portions 221. Non-engagement portion 221 is disposed intermediate tongue portions 217 and engagement portions 219 such that portions 217, 219 integrally communicate with non-engagement portion 221, as best illustrated in FIG. 12. Spring 285 is oriented in support frame 214 so that plurality of engagement portions 219 respectively face towards, and communicate with plurality of receptacles 216, as best illustrated in FIG. 11. Engagement portions 219 are also generally in axial alignment with receptacles 216. Engagement portions 219 absorb axial, Z-axis positional mating tolerance variation between each male connector 222 and each female connector 220 that is manifested in respective receptacles 216 when connectors 220, 222 are mated. Referring to FIGS. 7 and 12, non-engagement portion 221 secures spring 285 with support frame 214 primarily through plurality of tongue portions 217 that are adhesively bonded in a plurality of apertures 223 of support frame 214. Apertures 223 are defined in tower structures 227 of support frame 214 and are spaced axially apart, yet generally axially aligned with each receptacle in plurality of receptacles 216. As such, non-engagement portion 221 is also disposed intermediate plurality of engagement portions 219 and support frame 214, as best illustrated in FIGS. 13 and 14. Plurality of receptacles 216 are formed in support frame 214 to constitute a row 218 that is generally perpendicular to mating axes $A_1$, $A_2$, $A_3$. Engagement portions 219 are disposed on support frame 214 to have an adjacent, parallel relationship with plurality of receptacles 216 in row 218.

Preferably, resilient spring 285 is constructed from an elastomeric material, preferably such as a thermoplastic rubber or elastomer (TPE), or a silicone material. A TPE material is a polymer blend or compound which, when above its melt temperature, exhibits a thermoplastic character that enables it to be shaped into a fabricated article and which, within its design temperature range, possesses elastomeric behavior without cross-linking during fabrication. This process using TPE materials is reversible and the products can be reprocessed and remolded. The elastomeric material in a solid state may feel to the physical touch of a human finger like a spongy, rubbery-type material. Even more preferably, spring 285 is co-molded together with support frame 214 when support frame 214 is injection molded where spring 285 is formed as a single contiguous piece, as best illustrated in FIG. 12. Spring 285 is secured to support frame 214, primarily through adhesion of spring 285 to external surfaces of support frame 214 during the co-molding process. Preferably, the adhesive property of spring 285 is associated with the elastomeric material being used. Plurality of tongue portions 217 have adhesion with surface area of support frame 214 surrounding plurality of apertures 223 defined in support frame 214 which help to stabilize spring 285 in support frame 214. The hot temperatures of the co-molding process help tongues 217 and apertures 223 to combine to firmly, mechanically attach spring 285 to support frame 214. Alternately, an adhesive applied intermediate the spring and support frame during the co-molding process may additionally be utilized to further secure the spring to the support frame. Still yet alternately, an adhesive may be used that chemically bonds, or fuses the spring to the support frame during the co-molding process in a manner that makes the spring integral with the support frame.

The co-molding of support frame 214 and spring 285 ensures spring 285 is formed within the structure of with support frame 214. Co-molding of support frame 214 and spring 285 involves a single mold process using a single mold cavity. Two mold halves (not shown) come together to define the single mold cavity. Support frame 214 is molded first with molten liquid plastic filling the mold cavity in the areas that form support frame 214. When molded support frame 214 is sufficiently cooled within the mold cavity, a coat of adhesive may be applied to the areas of molded support frame 214 that will make contact with what will become spring 285 such that the elastomeric material of spring 285 bonds with the adhesive which subsequently also chemically bonds to the material of support frame 214. The liquid elastomeric material is then injected into the single mold cavity on to the areas that form spring 285 that also make contact with support frame 214. In one embodiment, the liquid elastomeric material may be injected through apertures in the molded support frame that ultimately help to secure the spring to the support frame. As elastomeric spring 285 hardens into a solid, yet pliable state, spring 285 mechanically attaches to support frame 214. When molded spring 385 and support frame 214 are sufficiently cooled, the molded spring and support frame are released from the cavity of the mold. The co-molding of spring 285 and support frame 214 provides an advantage of precision location of the engagement portions sufficiently axially aligned within receptacles 216 so that predetermined axial positional mating tolerance variation within the predetermined tolerances across all of receptacles 216 in support frame 214 may be accurately absorbed by spring 285. This precision alignment may be even more important when the multiple connectors in the electrical connection system mate to a single electrical component in a single, unimpeded movement.

Referring to FIGS. 1, 5-7, and 9-10, arrangement 212 further includes a connector position assurance (CPA) lock 284, a retainer pin 286, a wire conductor retainer 287, and a retention tail 288. The components that make up arrangement 212 as listed above including support frame 214 and connectors 220, 222 are preferably formed using durable non-electrically conducting dielectric materials, such as nylon, polyester plastic material, and the like. Alternately, different fillers may be added to strengthen the dielectric material as required by a specific electrical application. Using non-electrically conducting materials ensure system 210 will not electrically conduct an electrical short whether one should one occur inside or outside of system 210. This provides further safety during the handling of electrical connection system 210, such as when system 210 is assembled, for example, in an electrical application in a vehicle or when being serviced by a service technician. Using a dielectric material to form support frame 214 is especially desirable when including integral fixed male connector **212*d* with support frame 214 as fixed male connector 212*d* may be injection molded when support frame 214 is molded. Connectors 220, 222 may also be formed by injection molding. Alternately, support frame 214 may be formed any material that may also include a metallic material. Still yet alternately, the fixed connector may be fastened to the support frame by any suitable manner, such as welding the fixed connector to the metal support frame. Fixed female connector 220*d* does not absorb axial positional mating tolerance variation, and hence, does not engage spring 285. Still yet alternately, arrangement 212** may further include an integrated lock arm that may be integral or fastened to the support frame and may secure tabs disposed on the respective male connecters when they are fully mated to the coupled female connectors. The terminals may be formed of any electrically conducting material, such as a metallic tin or brass alloy material. The wire conductors, or cables may be formed from a copper or aluminum alloy material.

Female connector **220*d* is fixedly attached to support frame 214 and preferably integrally molded to support frame 214 that may provide an alignment feature for the mating of the remaining connectors in system 210 if system 210 is mated to a single electrical device. CPA member 284 includes a groove (not shown) that is fitted to one or more rails 276 disposed on support frame 214 so CPA member 284 is movingly attached to support frame 214. CPA member 284 is disposed on support frame 214 adjacent receptacles 216 that are formed in support frame 214 in row 218. CPA member 284 communicates with mated connectors 220, 222 that enables CPA member to be moved to a position on support frame 214 and ensure mated connectors 220, 222 do not prematurely unmate. For example, a premature unmating may occur if an undesired force is applied along the mating axis that may accidentally unmate at least one of the plurality of second connectors from at least one of the plurality of first connectors when it is desired that unmating not occur. A premature unmating of the connectors in the electrical connection system may cause the electrical devices connected to the electrical connection system to become undesirably inoperative. CPA member 284 may be constructed of a metal material or a dielectric material similar to that of support frame 214**, as previously discussed herein. One such CPA member that prevents the female and the male connectors from prematurely unmating once completely mated together is described in non-provisional application U.S. Ser. No. 13/113,301 entitled "BI-DIRECTIONAL CPA MEMBER TO PREVENT UNMATING OF MULTIPLE CONNECTORS," and is incorporated by reference herein.

In contrast, connectors 220, 222 are fully, or completely mated together when the terminals of the connectors 220, 222 are mated together so that electrical connections are realized within electrical connection system 210. Additionally, connectors 220, 222 are fully engaged when ramp (not shown) of male connectors 222 are engaged with lock arms 203 of coupled female connectors 220. Connectors 220, 222 are further fully mated when CPA member 284 is positioned on support frame 214 to ensure fully mated connectors 220, 222 do not unmate.

Coupled female connectors 220*a-c* are additionally attached and secured to support frame 214 using retainer pin 286. Wire conductor retainer 287 further secures wire conductors 236 that communicate with female connectors 220 while also assisting to limit undesired rocking movement motion of support frame 214 when electrical connection system 210 is assembled together in an electrical application. Rocking motion of the electrical connection system during assembly in the electrical circuit application may cause undesired damage to the electrical connection system. Terminal 224 is electrically connected to wire conductor 236 that attach with other electrical components or systems.

Figure 3:
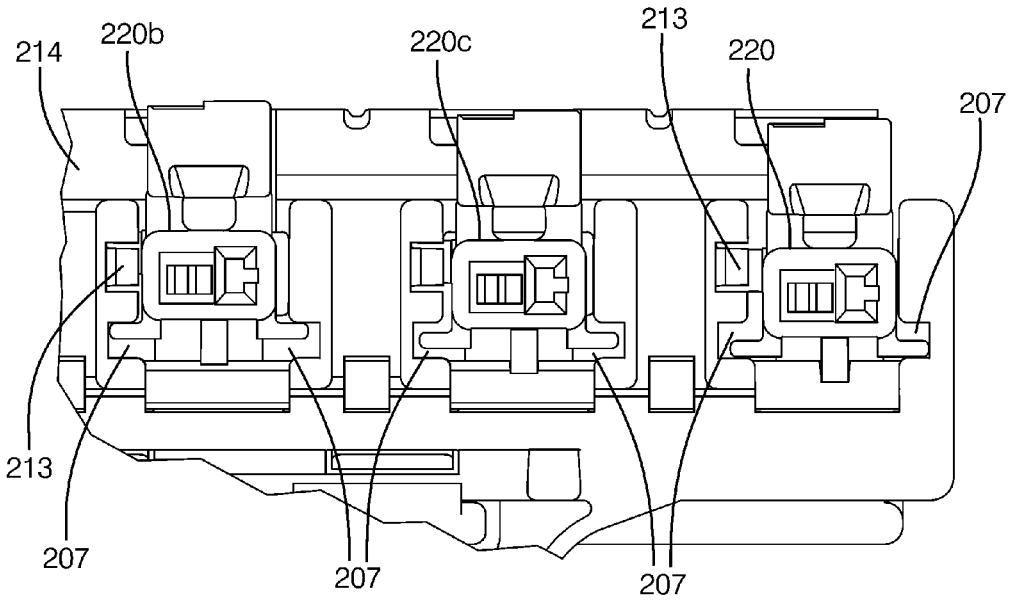
FIG. 3 shows a magnified view of the electrical connection system of FIG. 2, and possible float positions thereof.

Referring to FIG. 3, when receivably coupled in support frame 214, female connectors 220 including female connectors 220*a-c* movingly float about each receptacle in plurality of receptacles 216*a-c* in an X-axis, a Y-axis, and Z-axis direction in relation to each receptacle. Plurality of receptacles 216*a-c* absorb predetermined positional mating tolerance variation of male connectors 222*a-c* in relation to coupled female connectors 220*a-c* in an X-axis, Y-axis, and Z-axis direction about each receptacle in relation to each receptacle in plurality of receptacles 216*a-c*. The X-axis and the Y-axis direction are orthogonal to each respective mating axes $A_1$, $A_2$, $A_3$ for each receptacle in plurality of receptacles 216*a-c*. The Z-axis direction for each receptacle in plurality of receptacles 216*a-c* is co-axial with each mating axes $A_1$, $A_2$, $A_3$. Engagement portions 219 of spring 285 may absorb any amount of predetermined positional mating tolerance variation in the Z-axis direction manifested at each receptacle 216*a-c* when connectors 220, 222 are mated. Retention tail 288 is provides an additional wire routing mechanism for routing of wire conductors 236 when arrangement 212 is employed an electrical circuit application. Retention tail 288 also provides an aid for a human assembler or service technician to handle support frame 214 during assembly of arrangement 212 in an electrical circuit application.

Retainer pin 286 is used to further secure female connectors 220*a-c* to support frame 214. Retainer pin 286 has a length $L_3$ and includes an index rib 289, a pin retention feature 290, and a crush rib 291. Retainer pin 286 is insertable in a cavity 292 formed in support frame 214 that communicates with retention feet 293 on each of plurality of coupled female connectors 220*a-c*. Index rib 289 is disposed along a length $L_3$ of retainer pin 286 and is used to ensure retainer pin 286 is inserted in support frame 214 in a single orientation. Retainer pin 286 fits along length $L_1$ of support frame 214 to communicate with receptacles 218*a-c*. Length $L_1$ of support frame 214 is greater than length $L_3$ of retainer pin 286. Crush rib 291 is useful to force retainer pin 286 after insertion in cavity 292 in an opposing direction away from crush rib 291 against a portion of support frame 214 in cavity 292 to ensure a tight retention fit for female connectors 220*a-c* and eliminate the potential for female connectors 220*a-c* to have undesirable rattle noise when employed in the electrical configuration. For instance, this feature may be very important to prevent rattle when the electrical connection system is employed in a vehicle electrical circuit application.

Figure 8:
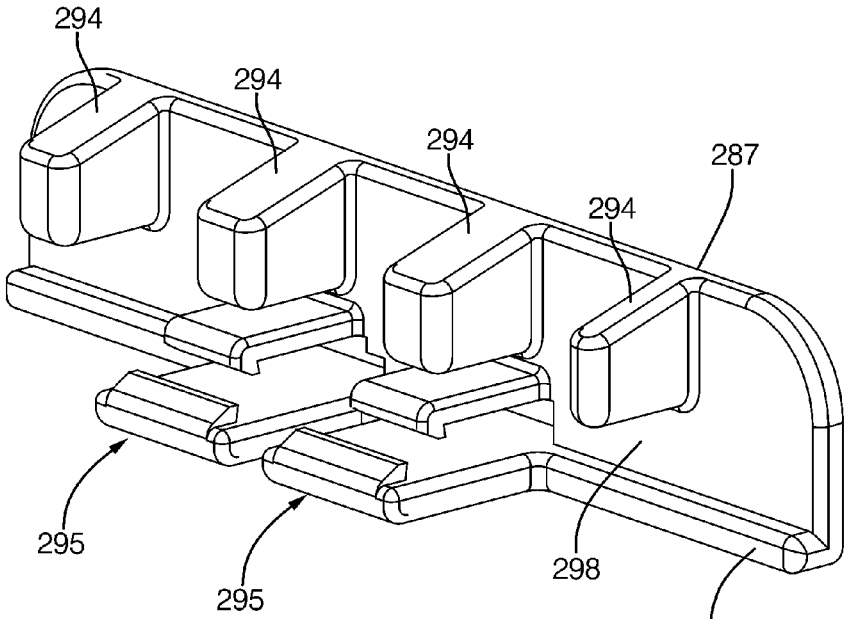
FIG. 8 shows a rear-side, left-hand view of a wire retainer for the arrangement of FIG. 7.
Figure 9:
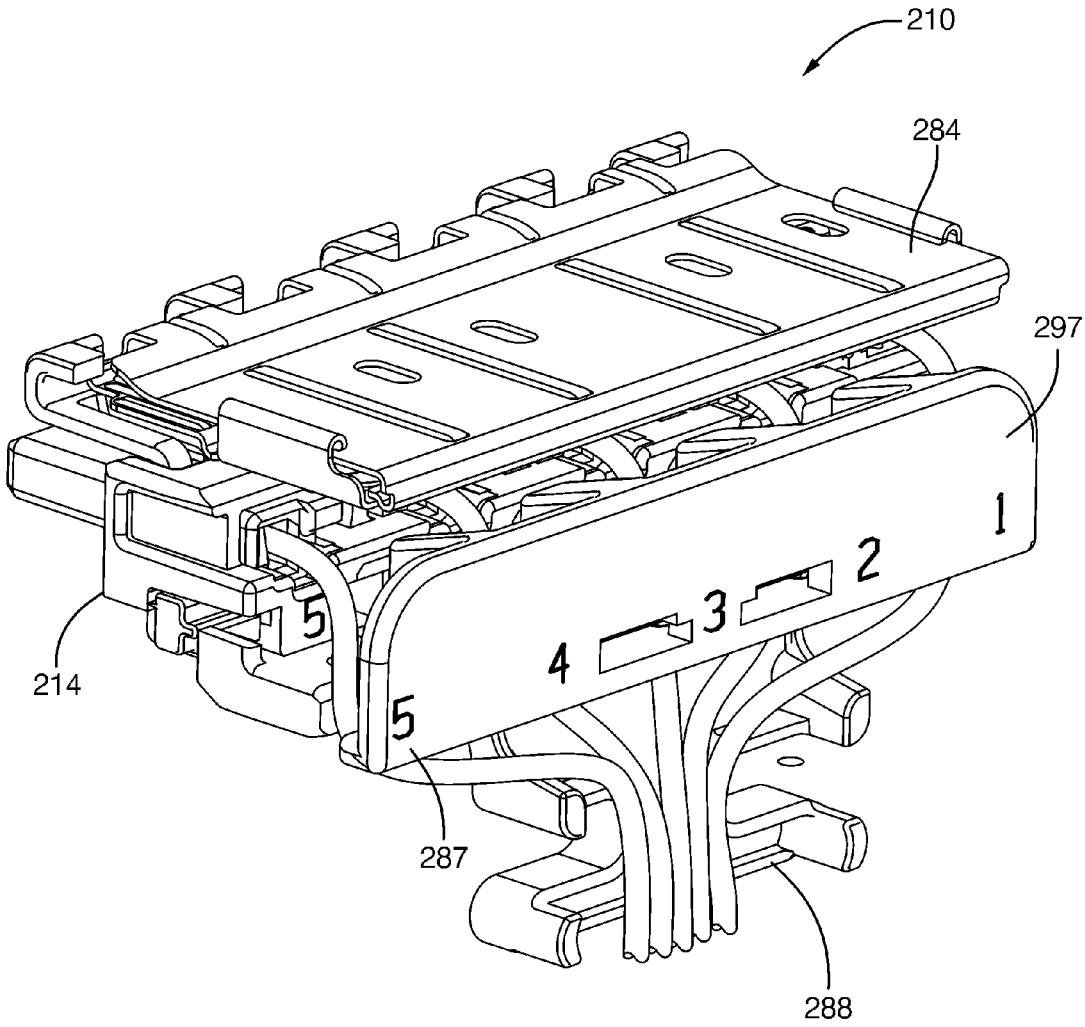
FIG. 9 shows the wire retainer of FIG. 8 attached to the arrangement of FIG. 7.
Figure 10:
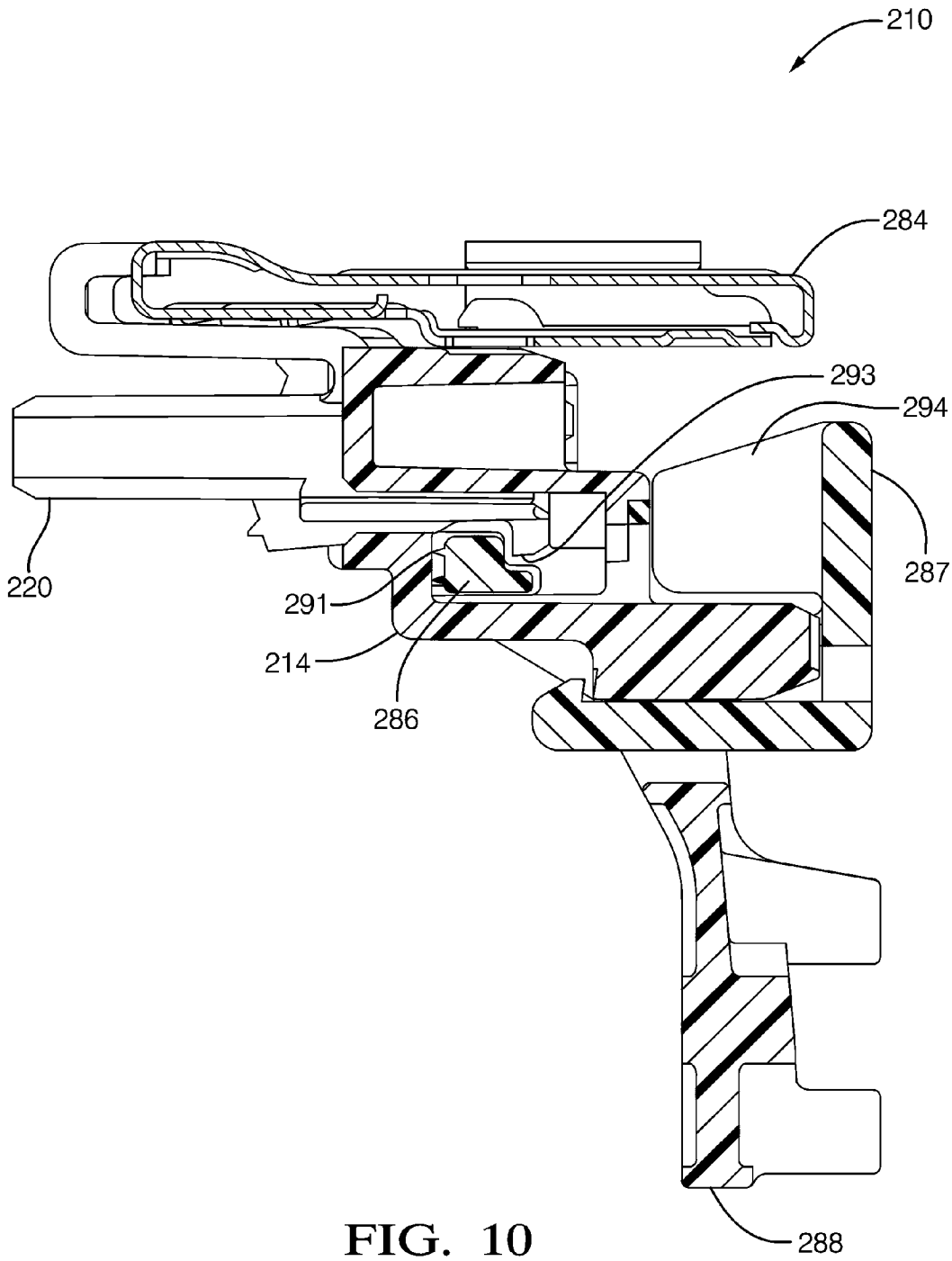
FIG. 10 shows a cross section view of the arrangement of FIG. 9, showing details thereof.

Referring to FIG. 8, wire conductor retainer 287 includes push pads 294, opposing locks 295, wire conductor retaining rail 296, a front face 297, and a rear face 298 opposing front face 297. Push pads 294 and locks 295 extend from rear face 298. Wire conductor retainer 287 is attached to support frame 214 so that push pads 294 abut support frame 214 and fit in a space in-between each receptacle in plurality of receptacles 216*a-c* to assist to limit undesired rocking motion of electrical connection system 210, as previously described herein. Opposing locks 295 communicate and connect with openings 209 in a clam shell-type manner to secure retainer 287 in support frame 214. When retainer 287 is attached to support frame 214, front face 297 serves as a push pad to stabilize and maneuver support frame 214 and female connectors 220 to mate with male connectors 222. Terminals 224 are inserted and fitted into forward section cavity 240*c* of female terminals 220 to reside in forward and rearward sections 272, 273 of cavities 240*a*, 240*c*. When wire retainer 287 is attached to support frame 214 using opposing locks 295, rail 296 abuts frame wire slots 299 to retain wire conductors 236 in frame wire slots 299. Retainer 287 assists to stabilize arrangement 212 and prevent undesired rocking motion to arrangement 212 during assembly of arrangement 212 in an electrical circuit application. Retainer 287 also assists to ensure a smooth mating connection of connectors 220, 222 especially when mating arrangement 212 with a single electrical device employing multiple connector connections.

Figure 4:
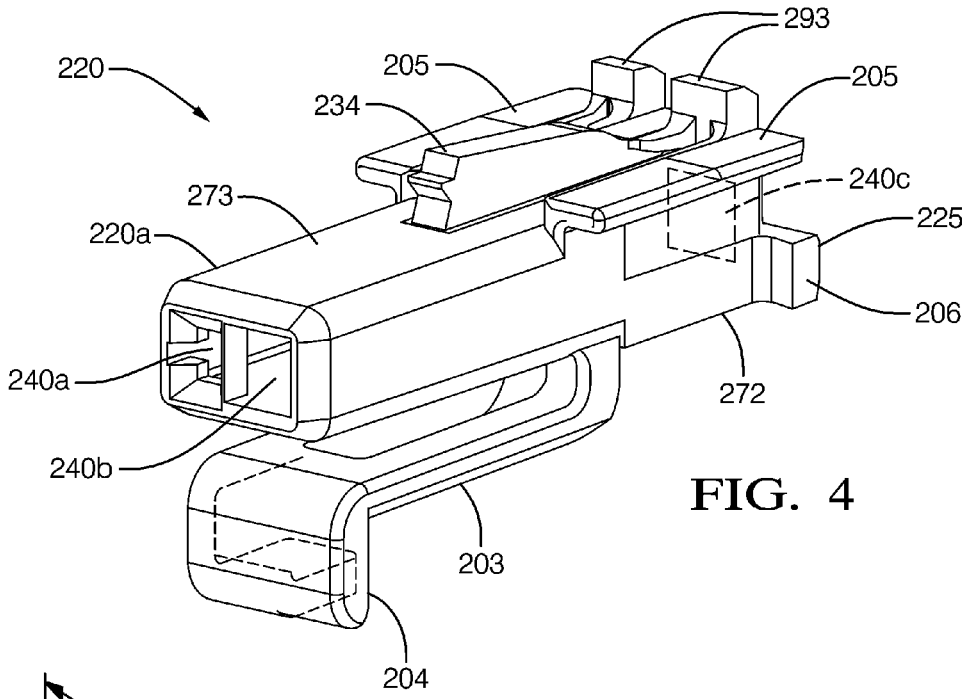
FIG. 4 shows a right-hand view of a first connector of the electrical connection system of FIG. 1.
Figure 5:
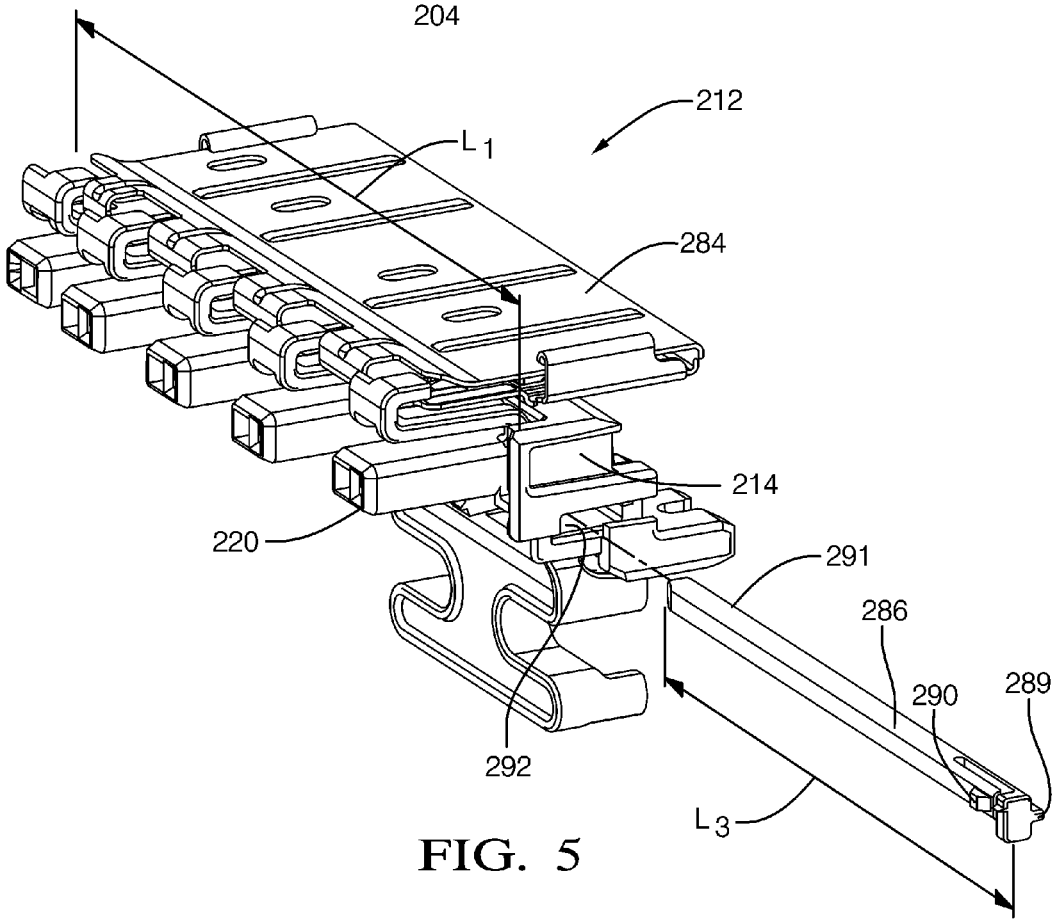
FIG. 5 shows the arrangement of FIG. 2 with a retainer being inserted into a support frame of the arrangement.
Figure 6:
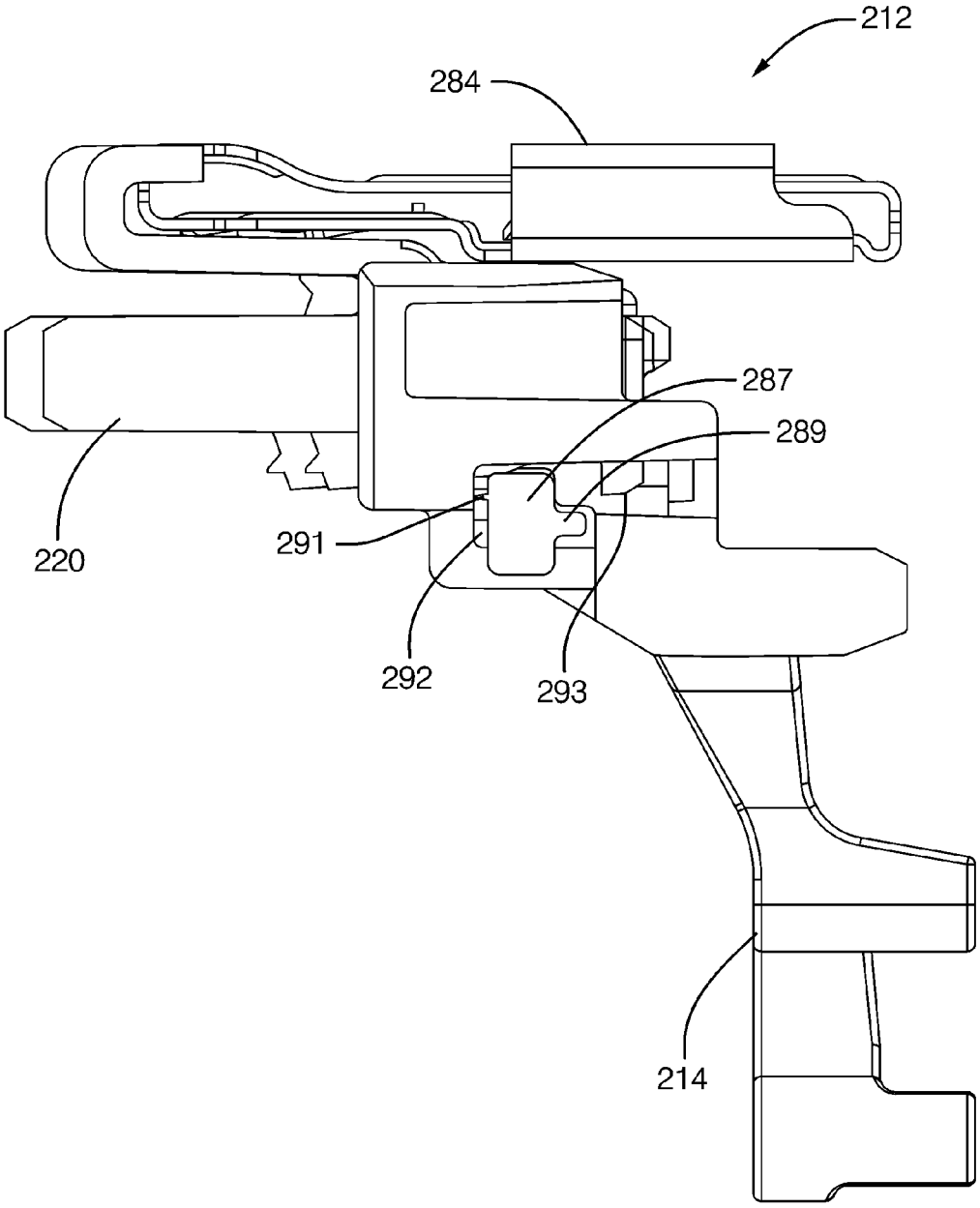
FIG. 6 shows a side view of the arrangement of FIG. 5, showing details thereof.

Referring to FIG. 4, female connector 220*a* includes forward section 272 and rearward section 273. Forward section 272 and rearward section 273 are generally axially aligned and not laterally offset when connectors 220*a*, 222*a* are mated. Forward section 272 of coupled female connectors 220*a-c* are configured to engage engagement portion 217 so spring 285 absorbs axial positional mating tolerance variation when male connectors 220 mate to female connectors 222. Rearward section 273 of female connectors 220 receivingly attach with male connectors 222 when connectors 220, 222 are mated. Fixed connector 220*d* receives male connector 222, but being fixedly attached in support frame 214, does not engage spring 285. Arrangement 212 is constructed to have little or no clearance between face 225 of female connectors 220 and engagement portion 219 of spring 285, even when factoring in the manufacturing tolerances to construct support frame 214 and female connectors 220. When female connectors 220*a-c* are coupled in receptacles 216, however, there may be some residual clearance, or gap between face 225 of female connector 220*a-c* and engagement portions 219 of spring 285 in one or more of receptacles 216. As male connectors 220 are not yet mated to female connectors 220, there will be marginal or no compression force of face 225 of female connectors 220 against engagement portions 219 of spring 285. Faces 225 of coupled female connectors 220 will engage engagement portions 219 when a sufficient amount of axial positional mating tolerance variation is manifested at receptacles 216 to so that a compression force of coupled female connectors 220 engages faces 225 against engagement portions 219 when connectors 220, 222 are fully mated. Female connector 220*a* includes a primary terminal lock (not shown) and a secondary terminal lock 234, as previously described herein. Female connectors 220 are indexed with receptacles 216 as connector rails 205 fit with slots 207 in a single orientation. A lock arm 203 is formed in a general U-shape that extends from an exterior surface of female connector 220*a*. A portion of lock arm 203 includes a face 204 disposed distally on lock arm 203 from the exterior surface of female connector 220*a*. Face 204 is adapted to oppose a protrusion wall 233 of CPA member 284 to prevent male connector 222*a* from prematurely unmating from female connector 220*a*. Female connector 220*a* also includes retention feet 293 that communicate with retainer pin 286, as previously discussed herein. Two laterally-disposed connector rails 205 on female connector 220*a* are axially inserted in two corresponding axial slots 207 in receptacles 216 when female connectors 220 are receivably coupled in receptacles 216.

When female connectors 220*a-c* are receivably coupled in receptacles 216, shoulders 206 urge against flexible lock 203 so as to deflect flexible lock 208 until shoulders 206 move past flexible lock 203 and flexible lock deflects back to a position so as to lock and seat female terminal 220 in receptacle 216. A flexible connector lock 213 retains female connectors 220*a-c* in receptacles 216. Connector rails 205 and slots 207 are suitably and sufficiently sized based on the predetermined positional mating tolerance variation that needs to be absorbed by receptacles 216. While coupled female connectors 220*a-c* have floatable movement about slots 207. Female terminal 220*b* is shown positioned in slots 207 in a top/left position, female terminal 220*c* is shown positioned in slots 207 in a central position, and female terminal 220 on the left portion of FIG. 3 is shown positioned in slots 207 in a bottom/right position. Flexible terminal locks (not shown) lock in female terminals 224 in female connectors 220 so terminals 224 remain secured in female connectors 220.

When arrangement 212 is ready for assembly in an electrical circuit application retaining pin 286 is inserted in cavity 292 after female connectors 220 are received in slots 207 of support frame 214. Wire conductor retainer 287 is also installed preferably have connectors 220, 222 have been mated and wire conductors 236 dressed.

Spring 285 is initially constructed in support frame 214 when support frame 214 and spring 285 are co-molded together in the same mold (not shown).

Spring 285 is not in use when first connectors 220 are not receivably coupled in plurality of receptacles 216.

When first connectors 220 are receivably coupled in receptacles 216 and first connectors 220 are not mated with second connectors 222, spring 285 is not in use even though first connectors 220 may freely move within slots 207 such that forward sections 272 of first connectors 220 may even make physical contact with springs 285. Coupled first connectors 220 may have a small amount of axial movement within receptacles 216 when second connectors 222 are not mated with first connectors 220, however, there is little, or no compression of engagement portions 219 by first connectors 220 if first connectors make contact with engagement portions 219. When male connectors 222 are not mated with first connectors 220, movement of support frame 214 may cause coupled first connectors 220 to have a rattle-type noise as coupled first connectors 220 freely move within receptacles 216 and engage against portions of support frame 214.

When first connectors 220 are receivably coupled in receptacles 216 and first connectors 220 are mated with second connectors 222, springs 285 are in use in electrical connection system 210. As male connectors 222 are mated to female connectors 220, any axial positional mating tolerance variation at any given receptacle 216 may be absorbed by respective engagement portions 219 of spring 285. In electrical configurations where the male connectors are associated with a single electronic device or system, plurality of engagement portions 219 may absorb the axial positional mating tolerance variation as the device or system is mated to support frame 214 in a single, unimpeded movement. As engagement portions 219 along a length $L_5$ of spring 285 have the resilient, spongy, rubbery property characteristic of elastomeric spring 285, engagement portions 219 absorb any amount of the axial predetermined positional mating tolerance variation at each receptacle. Spring 285 may absorb axial positional mating tolerance variation with many repeated matings of connectors 220, 222.

Similar elements in the embodiment of FIGS. 1-10 herein are shown having the same reference numerals in the embodiment of FIGS. 13-22 of application U.S. Ser. No. 13/113,286 entitled "ELECTRICAL CONNECTION SYSTEM THAT ABSORBS MULTI-CONNECTOR POSITIONAL MATING TOLERANCE VARIATION."

Alternately, the male connectors may be electrically connected to a plurality of battery cells that form a battery stack. The battery stack then is mated to the electrical connection system in a single, unimpeded movement. The plurality of engagement portions of the spring would then absorb axial positional mating tolerance variation from each individual battery cell when the male and female connectors are mated. In another alternate embodiment, the battery cells may be associated with an electric vehicle, a hybrid electric vehicle, or a plug-in electric vehicle.

In a further alternate embodiment, any type of spring may be used in any type of arrangement to absorb axial positional mating tolerance variation in an electrical connection system having two connectors or a ganged electrical connection system having multiple connectors. The spring may be made from any durable material. For example, in addition to the elastomeric material as described herein, the spring may further be made of metal or a dielectric material. Further, for instance, the plastic spring may take the form of a plastic finger, or have a V-shape. The arrangement may be formed of a metal or a dielectric material. The connectors coupled in the support frame may also be formed any durable material.

In another alternate embodiment, the spring may be attached or fastened to the support frame apart from the molding process. For example, while a spring may be fastened to the support frame outside of the co-molding process, this type of attachment may undesirably affect the location of the engagement portions within the receptacles so as to not be as precisely aligned with the receptacle and not be able to accurately absorb all of the predetermined axial positional mating tolerance variation that may be manifested at any given receptacle. Thus, when the fit of the spring to the support frame is less precise, the absorption of Z-axis positional mating tolerance variation may further be undesirably affected so that an arrangement with a fastened spring may have a lower quality than a support frame where the spring has been co-molded within the support frame.

In a further embodiment, a spring may be attached to the support frame by being manually attached to the support frame by a human operator or machine. Thus, the spring may be snapped in to support frame. In yet another embodiment, an adhesive applied to the spring may further be utilized to secure the snapped-in spring to the support frame. Still yet alternately, the spring may be formed of any material such as plastic or metal.

In yet another further embodiment, undercuts in the tongues or other portions of the spring that communicate with the support frame may enhance the mechanical attachment of the spring to the support frame.

In still yet another alternate embodiment, the size of the arrangement and the components used to construct the arrangement may be made of any size and length dependent on the electrical application of use. For example, if larger AWG wire is required in the application, a larger electrical connection system may require construction to fit the larger AWG wire sizes.

Thus, a reliable, robust electrical connection system that allows for positional mating tolerance variation between multiple connectors where each connector has an X- and a Y- and a Z-axis positional mating tolerance variation component in the electrical connection system where at least the axial positional mating tolerance variation is absorbed within the electrical connection system has been presented. The electrical connection system attains repeatable, consistent, and high-quality electrical connections when connectors in the electrical connection system are repeatedly mated and unmated. Additionally, the electrical connection system is unaffected by the number of mating devices and/or the number of terminations within the mating devices in the mating device arrangement, resulting in mating multiple connectors in the electrical connection system. A spring formed from a elastomeric material is co-molded with a support frame in a single injection mold such that the spring is securely adhesively attached to the support frame during the molding process. The spring is formed in a single contiguous piece and includes engagement portions that extend from a non-engagement portion of the spring that engage the coupled female connectors in the support frame to absorb the axial positional mating tolerance manifested at each receptacle disposed in the support frame. The non-engagement portion is an interface between the engagement portions and the tongues of the spring where the tongues communicate with apertures spaced along a length of the support frame that secure the spring to the support frame. The engagement portions of the spring have an adjacent, parallel relationship with the row of receptacles of the support frame so that every receptacle includes an engagement portion of the spring to absorb the axial positional mating tolerance variation when connectors in the ganged electrical connection system are mated. The co-molding process allows the spring to be constructed in the support frame in a manner the allows for precision absorption of any amount of predetermined positional mating tolerance variation within each receptacle in the plurality of receptacles.

While this invention has been described in terms of the preferred embodiment thereof, it is not intended to be so limited, but rather only to the extent set forth in the claims that follow.

It will be readily understood by those persons skilled in the art that the present invention is susceptible of broad utility and application. Many embodiments and adaptations of the present invention other than those described above, as well as many variations, modifications and equivalent arrangements, will be apparent from or reasonably suggested by the present invention and the foregoing description, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the following claims and the equivalents thereof.

We claim:

1. An electrical connection system comprising:

an arrangement defining a plurality of receptacles and including a spring having a plurality of engagement portions in communication with the plurality of receptacles;

a plurality of first connector housings respectively including at least one electrical contact, said plurality of first connector housings being receivably coupled in the plurality of receptacles; and a plurality of second connector housings including at least one mating electrical contact, said plurality of second connector housings being matable to the plurality of coupled first connector housings along mating axes and the at least one mating electrical contact being matable to the at least on electrical contact of the plurality of coupled first connector housings also along said mating axes, wherein the plurality of receptacles are configured for floatable movement of the plurality of coupled first connector housings therein, said floatable movement being in at least an axial direction in relation to the plurality of receptacles so that axial positional mating tolerance variation of each second connector housing in the plurality of second connector housings in relation to each coupled first connector housing in the plurality of coupled first connector housings that manifests at each receptacle in the plurality of receptacles is assimilated by each respective spring engagement portion in the plurality of engagement portions of the arrangement when the plurality of second connector housings mate to the plurality of coupled first connector housings and said at least one mating electrical contact associated with plurality of second connector housings mate with said at least one electrical contact associated with the plurality of coupled first connector housings.

2. The electrical connection system according to claim 1, wherein the arrangement comprises a support frame and the spring is formed as a single contiguous piece secured to the support frame, the spring and the arrangement being respectively formed from the same material.

3. The electrical connection system according to claim 1, wherein each first connector housing in the plurality of first connector housings includes a forward and a rearward section and the spring further includes a non-engagement portion, said forward section of each coupled first connector engagingly contacts each respective engagement portion when said axial positional mating tolerance variation is manifested at the respective receptacle in the plurality of receptacles, and said non-engagement portion is disposed intermediate the respective plurality of engagement portions of the spring and a support frame so as to communicate with both the engagement portions and the support frame, said non-engagement portion securing the spring to the support frame.

4. The electrical connection system according to claim 1, wherein the plurality of receptacles are formed in the arrangement to constitute a row that is generally perpendicular to the mating axes, and said plurality of engagement portions of the spring have an adjacent, parallel relationship axially aft of said plurality of receptacles in said row.

5. The electrical connection system according to claim 1, wherein each spring engagement portion is moveable in the axial direction by engagement with a coupled first connector housing in the plurality of coupled first connector housings when said axial positional mating tolerance variation is manifested at a receptacle in the plurality of receptacles when a second connector housing in the plurality of second connector housings mates with a coupled first connector housing in the plurality of coupled first connector housings.

6. The electrical connection system according to claim 1, wherein each first connector housing in the plurality of first connector housings includes a forward section and a rearward section and the spring further includes a non-engagement portion, and an edge of said forward section of each coupled first connector housing engagingly contacts each respective engagement portion when said axial positional mating tolerance variation is manifested at the respective receptacle in the plurality of receptacles, and said non-engagement portion is disposed intermediate the respective plurality of engagement portions of the spring and a support frame so as to communicate with both the engagement portions and the support frame, and a portion of the non-engagement portion engages with an aperture defined in the arrangement to secure the spring thereto.

7. The electrical connection system according to claim 1, wherein the spring is attachingly secured to the arrangement in a molding process.

8. The electrical connection system according to claim 1, wherein the spring is formed of a dielectric material, and the arrangement is formed of a dielectric material, wherein said dielectric spring is attached to said dielectric arrangement thereto without the use of a fastener.

9. The electrical connection system according to claim 8, wherein each first connector housing in the plurality of first connector housings includes a forward section and a rearward section and the dielectric spring further includes a non-engagement portion, and an edge of said forward section of each coupled first connector housing engagingly contacts each respective engagement portion when said axial positional mating tolerance variation is manifested at the respective receptacle in the plurality of receptacles, and said non-engagement portion is disposed intermediate the respective plurality of engagement portions of the dielectric spring and a support frame so as to communicate with both the engagement portions and the support frame, and a portion of the non-engagement portion engages with an aperture defined in the dielectric arrangement to secure the dielectric spring thereto.

* * * * *